US006703799B2

(12) United States Patent
Summerford et al.

(10) Patent No.: US 6,703,799 B2
(45) Date of Patent: Mar. 9, 2004

(54) ARENA REFLECTOR ASSEMBLY

(75) Inventors: Robert L. Summerford, Schertz, TX (US); Randall P. Bergin, Seguin, TX (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 10/251,086

(22) Filed: Sep. 20, 2002

(65) Prior Publication Data

US 2003/0053314 A1 Mar. 20, 2003

Related U.S. Application Data

(60) Provisional application No. 60/323,578, filed on Sep. 20, 2001.

(51) Int. Cl.[7] ..... F21V 7/00
(52) U.S. Cl. ..... 315/342; 362/290
(58) Field of Search ..... 315/342; 362/147, 362/265, 354, 290, 291, 260, 240, 237

(56) References Cited

U.S. PATENT DOCUMENTS

| | | | | |
|---|---|---|---|---|
| 1,246,728 A | | 11/1917 | Downey | |
| 1,941,503 A | | 1/1934 | Villiers | |
| 3,790,774 A | * | 2/1974 | Miller et al. | 362/220 |
| 4,261,028 A | | 4/1981 | Adam | |
| 4,390,934 A | | 6/1983 | Willing | |
| 5,313,379 A | | 5/1994 | Lemons et al. | |
| 5,363,293 A | | 11/1994 | Lasker | |
| 5,383,102 A | | 1/1995 | Jones | |
| 5,586,015 A | | 12/1996 | Baldwin et al. | |
| 5,707,142 A | | 1/1998 | Gordin | |
| 5,938,317 A | | 8/1999 | Thornton | |
| 6,234,643 B1 | * | 5/2001 | Lichon, Jr. | 362/147 |
| 6,238,065 B1 | | 5/2001 | Jones | |
| 6,260,981 B1 | * | 7/2001 | Fiene | 362/147 |

* cited by examiner

*Primary Examiner*—Don Wong
*Assistant Examiner*—Chuc Tran
(74) *Attorney, Agent, or Firm*—Charles G. Lamb; Middleton Reutlinger

(57) ABSTRACT

An arena light reflecting assembly includes an asymmetric parabolic shaped reflector having an exit aperture. The reflector surrounds a horizontally extending high intensity light source and has a focal axis that lies along an axis of an arc tube of the light source so that the reflector acts as a collimator redirecting light from the light source into essentially parallel rays from the exit aperture. A pan circumscribes the exit aperture and a louver assembly is disposed within the exit aperture behind a front surface of the pan.

36 Claims, 8 Drawing Sheets

ARENA REFLECTOR ASSEMBLY

CROSS REFERENCE TO RELATED APPLICATIONS

This is a utility application of provisional application filed Sep. 20, 2001, Serial No. 60/323,578.

BACKGROUND OF THE INVENTION

1. Field of the Invention

This invention relates to sports and recreational area lighting, and more particularly, to an improved reflector assembly for television coverage level illumination of the Primary Play Area in an indoor arena, while controlling glare to the spectators seated around the PPA.

2. Description of Prior Art

In the past, arena lighting for sports and recreational events covered by television broadcast has been driven by the television requirements for intense and uniform light levels for the television cameras to capture the often quick moving action of the event.

Since the Primary Play Area (PPA) in most arenas is rectangular or oblong shaped for most events, such as basketball, ice hockey or rodeo, the need for adequate horizontal and vertical illuminance levels has led to the placement of large numbers of high intensity luminaires along catwalks suspended along arena ceilings parallel to and outside of the long sides of the PPA.

Uniform illumination of the PPA can be achieved by aiming the luminaires at various target locations in the PPA. Since light intensity varies inversely as the square of the distance between the light source and the point being illuminated, it is necessary to aim more luminaires at target locations on the opposite side of the PPA from the catwalk location. This placement has proven to provide adequate horizontal and vertical illumination of the PPA, but also has caused intense illumination of the spectator seating areas in the lower arena, particularly from luminaires aimed at target locations from the opposite catwalk. This spill light is seen as glare to the spectators seated in such areas, causing visual discomfort in viewing the event.

Additionally, a popular light source of choice among arena lighting designers is the position oriented high intensity discharge (HID) metal halide type lamp, which provides high lumens per watt efficacy and good color rendering. These types of lamps do not reach full light output immediately upon starting, but must warm up over a period of several minutes. Upon reaching operating temperatures, if the lamp is extinguished, it will not relight until it is cooled sufficiently to allow the arc to restrike with the available starting voltage. This time could be 15 minutes or longer.

However, event planners have requested the ability to darken the arena for special effects, such as spotlights and fireworks, at pre-selected times during events, such as player introductions and half-time shows, while being able to return the arena to full brightness immediately upon completion of the special effects portion of the event.

Thus, arena luminaire designers have developed systems for HID type luminaires to simulate instant on/off of the luminaire for special effects while the lamp continues to remain on within the luminaire. These shutter systems require that the components of the optical system of the luminaire be contained within the front opening of the luminaire, so that the shutter doors may close and block the light produced by the lamp.

Further, since the luminaires must be installed and maintained by workers on the small catwalks high above the arena floor, the size of the luminaires, and thus the size of the components within the luminaires, must be kept to a manageable size.

BRIEF SUMMARY OF THE INVENTION

Thus, it is an object of the present invention to provide a narrow beam reflector assembly with sharp cutoff optics.

It is a further object of the present invention to provide a reflector assembly that controls spill light to reduce glare to spectator seats in the lower arena.

It is a further object of the present invention to provide a HID reflector assembly with spill light control that can also be used with a shutter system to simulate instant on/off of the luminaire.

It is even a further object of the present invention to provide a reflector assembly with spill light control that has a reflector and louver assembly which is positioned behind the plane of a front pan.

It is even a further object of the present invention to provide a reflector assembly with spill light control of compact size.

More particularly, the present invention provides an arena light reflecting assembly. The arena light reflecting assembly includes an asymmetric parabolic shaped reflector having an exit aperture. The reflector surrounds a horizontally extending high intensity light source and has a focal axis that lies along an axis of an arc tube of the light source so that the reflector acts as a collimator redirecting light from the light source into essentially parallel rays from the exit aperture. A pan circumscribes the exit aperture and a louver assembly is disposed within the exit aperture behind a front surface of the pan.

The elements outlined herein are given primarily for the purpose of better understanding of the present invention. Many additional inventive concepts will be understood herein and none of these objectives are to be considered as limiting without taking into consideration the entirety of the teachings of the figures and specification together with any appended claims.

DETAILED DESCRIPTION OF THE INVENTION

The reflector assembly of the present invention utilizes HID sources, achieving the highest efficiencies possible, concentrating the light energy where required, while eliminating unwanted stray or spill light. The reflector assembly provides energy efficient, televisable light levels, but also keeps light levels on the audience to a minimum—reducing viewer glare and creating a more intimate venue for the observers.

Figure 1:
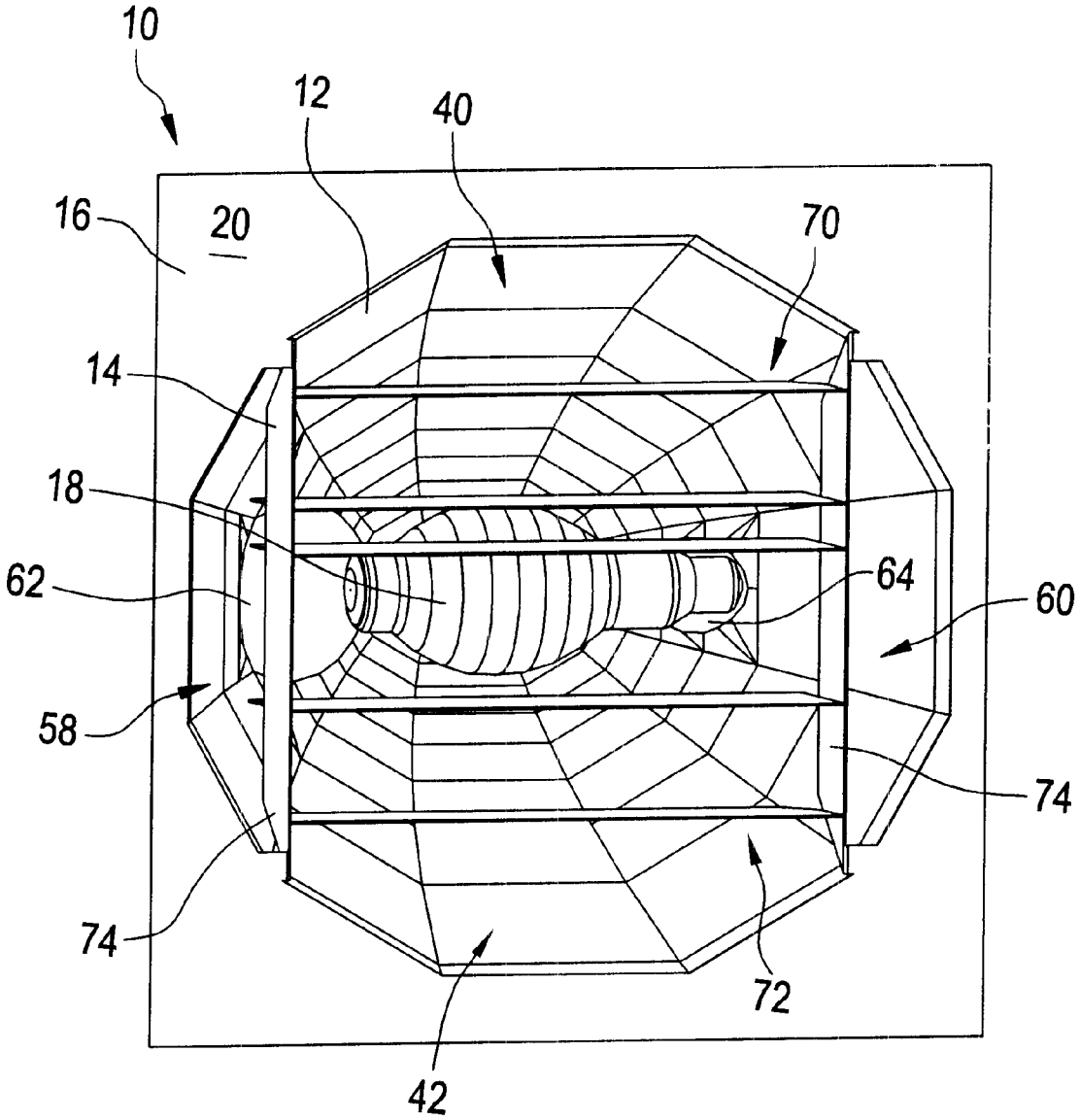
FIG. 1 is a perspective view of a reflector assembly of the present invention.

FIG. 1 shows an embodiment of the reflector assembly 10 of the present invention. As shown in FIG. 1, the reflector assembly 10 has a parabolic reflector 12, a louver assembly 14, and a front pan 16. Also shown is a HID lamp 18.

Figure 2:
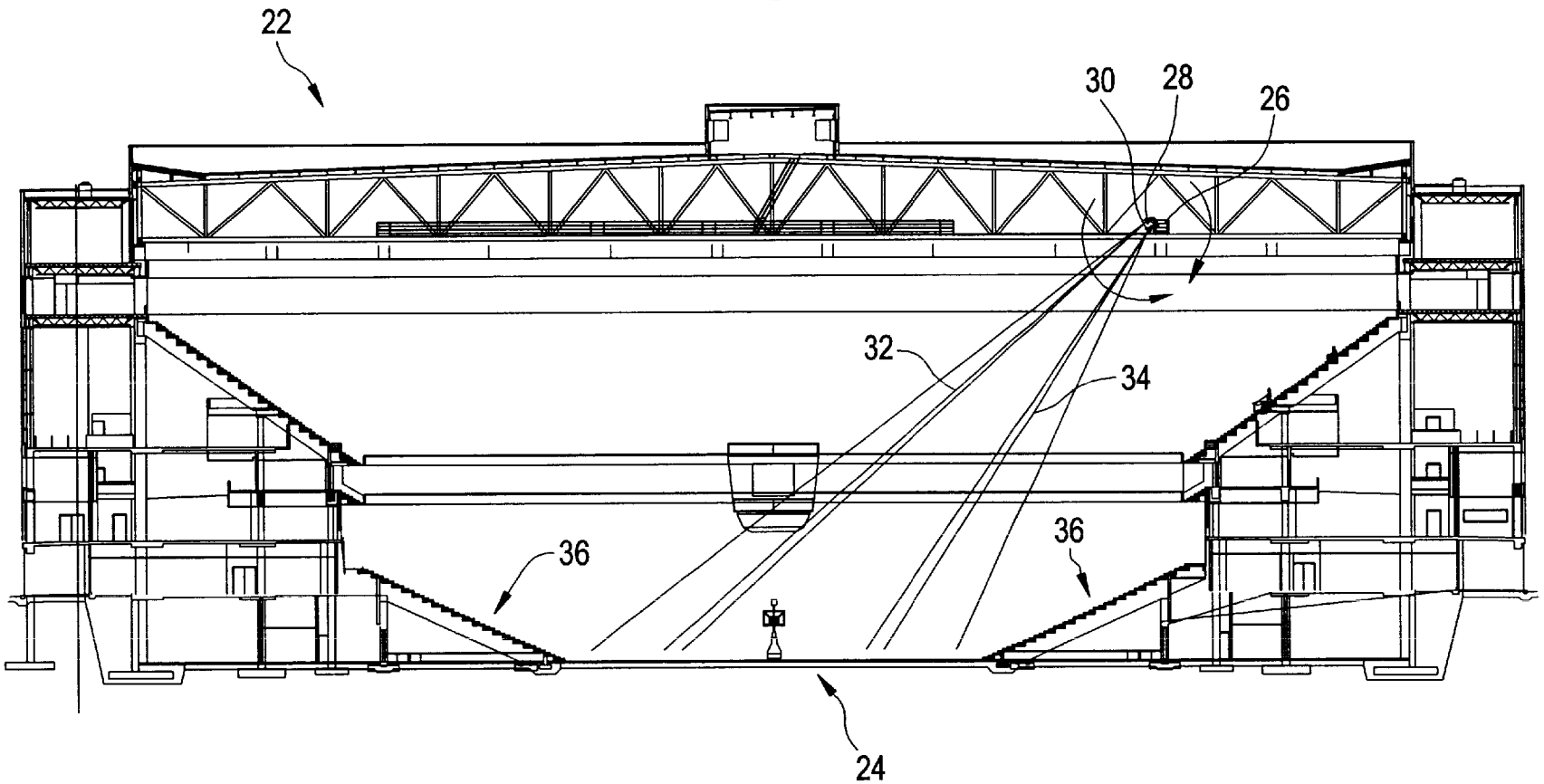
FIG. 2 is a side view of a representative arena showing typical aiming angles of arena luminaires utilizing the reflector assembly of the present invention.

FIG. 2 shows an arena 22 having a Primary Playing Area (PPA) 24 and a catwalk 24, which is suspended from the ceiling of the arena parallel to and outside of the PPA 24. Luminaires 28, 30 are attached to the catwalk 24 and have aiming vectors 32, 34. For example, the luminaire 28 having aiming vector 32 is aimed at a target area located on the opposite side of the PPA 24 from the location of the catwalk 26. The luminaire 30 having aiming vector 34 is aimed at a target area located on the closer side of the PPA 24 to the location of the catwalk 26. It should be noted that the luminaire 28 therefore has a higher aiming angle with respect to luminaire 30.

Since the object of the reflector assembly 10 of the invention is to provide adequate illumination of the PPA 24 while providing cut off of illumination from the spectator seats 36 adjacent to the PPA 24, this higher aiming angle requires a more intense cutoff of spill light exiting at the top 40 of the parabolic reflector 12 than it does at the bottom 42 of the reflector 12.

Figure 3:
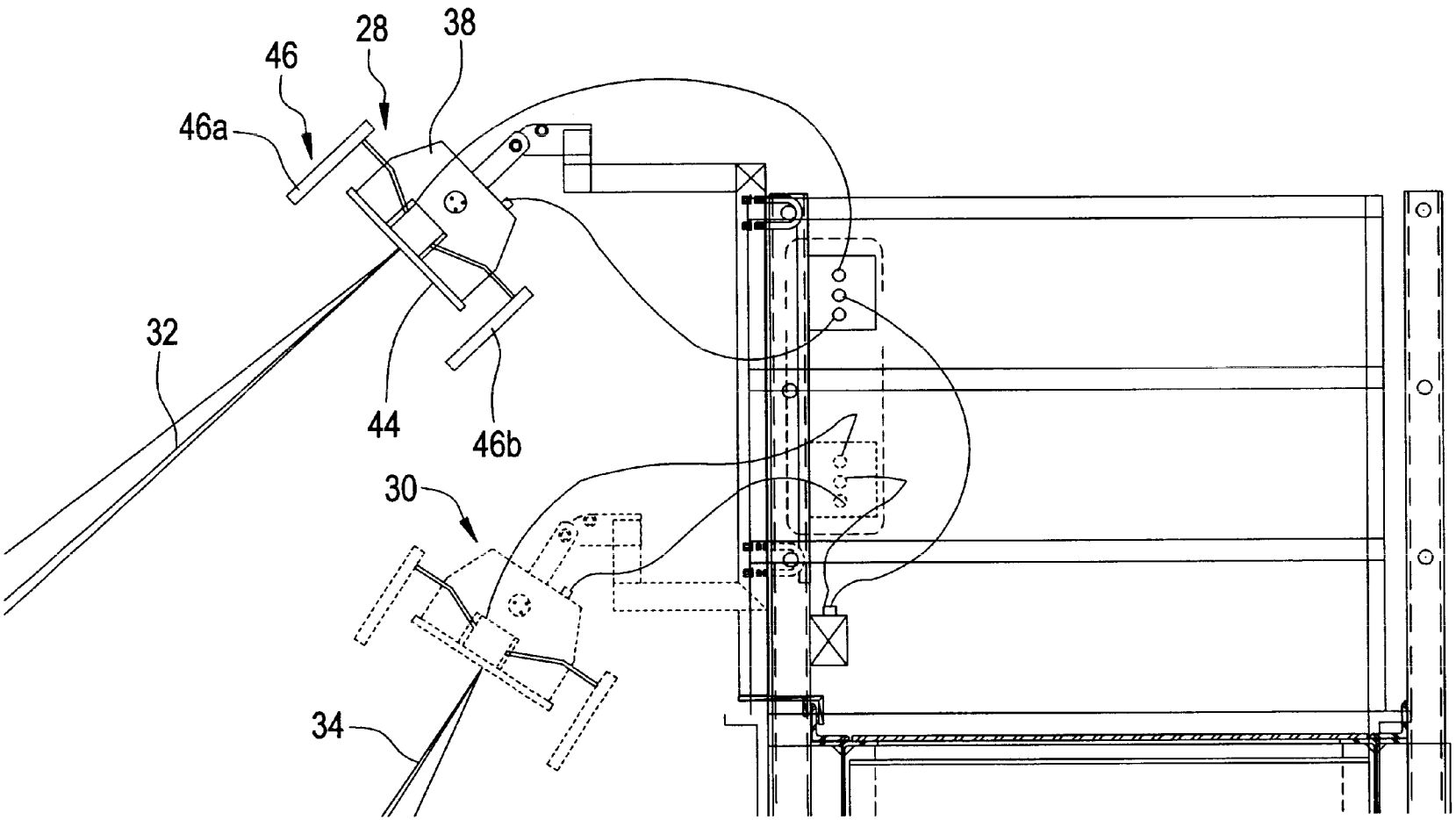
FIG. 3 is an enlargement of the area designated by 3—3 of FIG. 2, showing a side view of the catwalk with arena luminaires utilizing the reflector assembly of the present invention.

The reflector assembly 10 is preferably received within a housing 38, as shown in FIG. 3, to form a complete arena luminaire 28.

In the embodiment shown in FIG. 1, front pan 16 provides a mounting base for the reflector 12 and louver assembly 14. Front pan 16 has an oblong shaped opening, which receives the reflector 12 and louver assembly 14 such that the entire reflector 12 and louver assembly 14 are held behind the front surface 20 of the pan 16. The pan may be made of sheet metal or the like, and the reflector 12 and louver assembly 14 may be attached to the pan 16 by rivets, screws, or the like.

As shown in FIG. 3, a planar lens 44 may be placed over the reflector assembly 10 against the pan front surface 20 in order to create a barrier between the environment outside of the luminaire 28 and the inside of the luminaire 28. This not only protects the inside components of the luminaire 28 from the outside environment, but also protects the outside environment from non-passive failure of the HID lamp 18. In the preferred embodiment, a sheet of tempered glass is utilized as the planar lens 44.

Thus, the reflector assembly 10 of the present invention provides a planar front surface with no protruding light control devices, such as visors, louvers, or special lamp shields, in order to allow a shutter system 46, such as that shown in FIG. 3, to properly operate. Shutter system 46 includes a pair of moveable shutters 46*a*, 46*b*, positionably attached to housing 38.

As shown in FIGS. 4 through 9, the reflector assembly 10 cooperates with HID lamp 18 to redirect and control the light output from the HID lamp 18.

As is well known, high wattage HID lamps have an arc tube which is approximately 3 inches long and ½ inch in diameter. When in operation, the arc fills this tube, producing visible light output throughout the tube. Since the tube is cylindrically shaped, more light is emitted from the cylindrical walls of the tube than from the ends.

Further, it is known that position oriented HID lamps are capable of achieving higher efficacy (lumens per watt) than non position oriented (universal burn) type HID lamps. However, the horizontal burn HID lamp must be positioned such that the axis of its arc tube is parallel to the ground during operation.

Thus, as shown in FIG. 1, the reflector assembly 10 of the embodiment described herein utilizes a horizontal burn type HID metal halide lamp. The principals of the invention, however, may be applied to reflector assemblies having alternate lamps and orientations. The lamp of the embodiment described may be rated for either 750, 1000, or 1500 watts.

Figure 4:
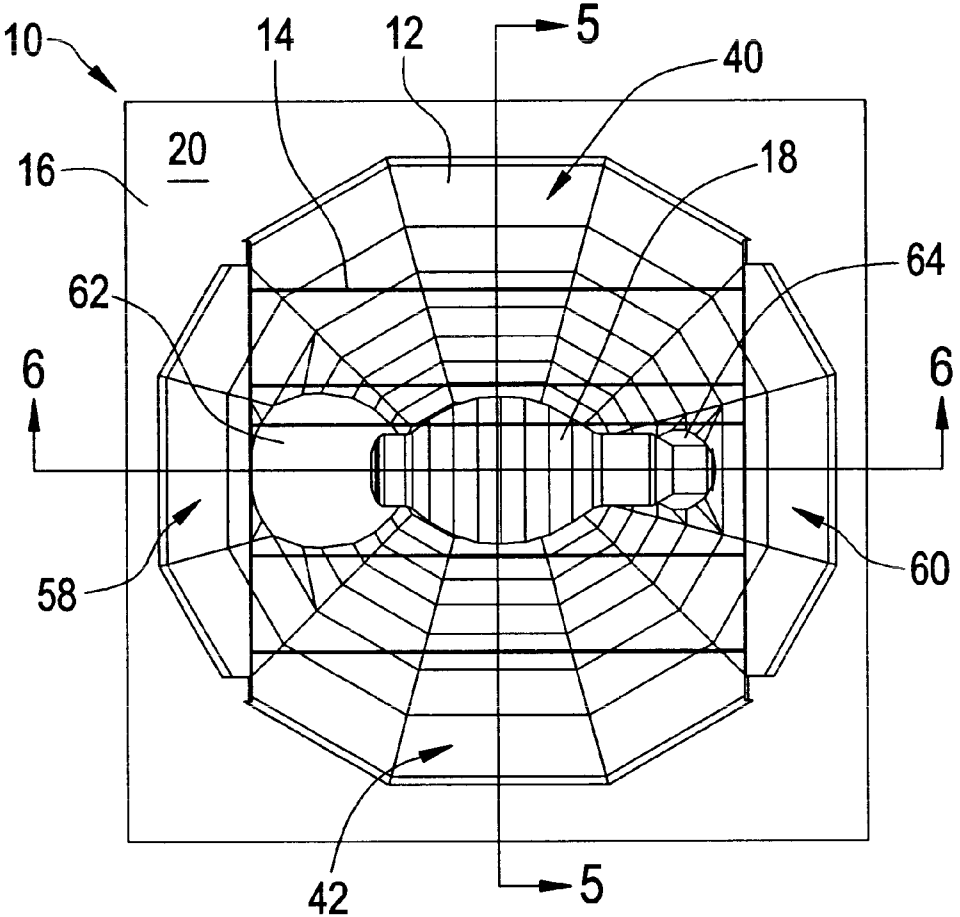
FIG. 4 is a top view of the reflector assembly of FIG. 1.
Figure 5:
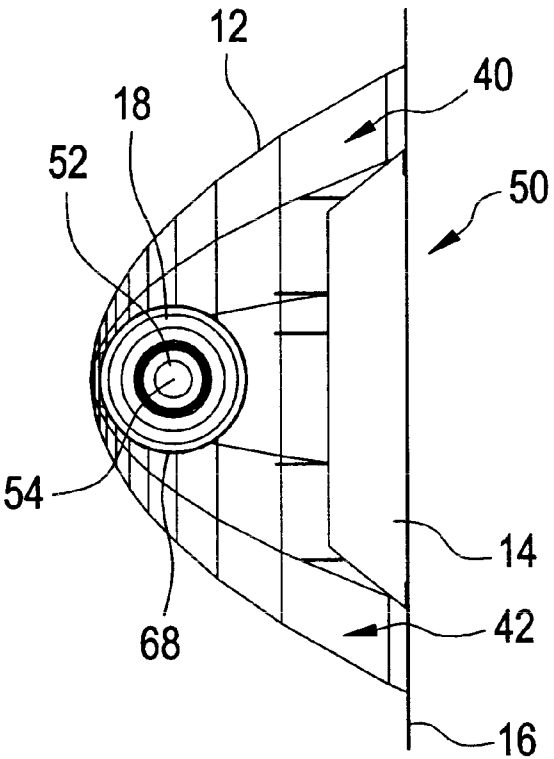
FIG. 5 is a top sectional taken along the sectional line 5—5 shown in FIG. 4.
Figure 6:
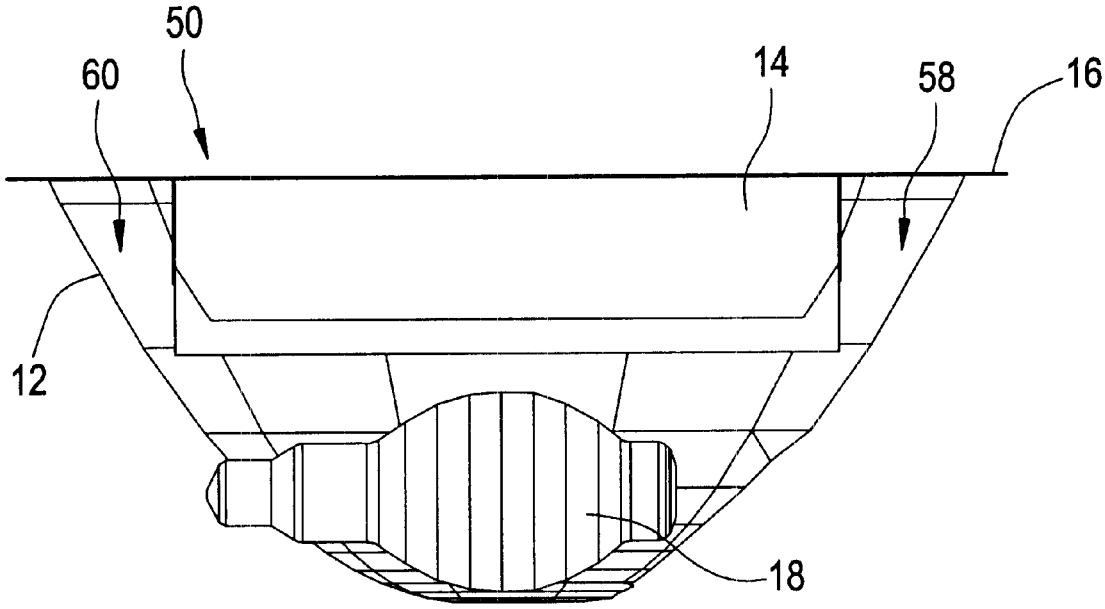
FIG. 6 is a sectional view taken through line 6—6 of FIG. 4.

As shown in FIGS. 4 through 6, the reflector assembly 10 of the embodiment described herein has an asymmetric parabolic shaped reflector 12 which has a focal axis 52 that lies along the axis 54 of the arc tube 56 of the HID lamp 18. Since the arc tube 56 of the HID lamp 18 is a horizontally oriented cylinder, the parabolic shaped reflector 12 has an oblong shape and produces an oblong shaped light output.

Figure 7:
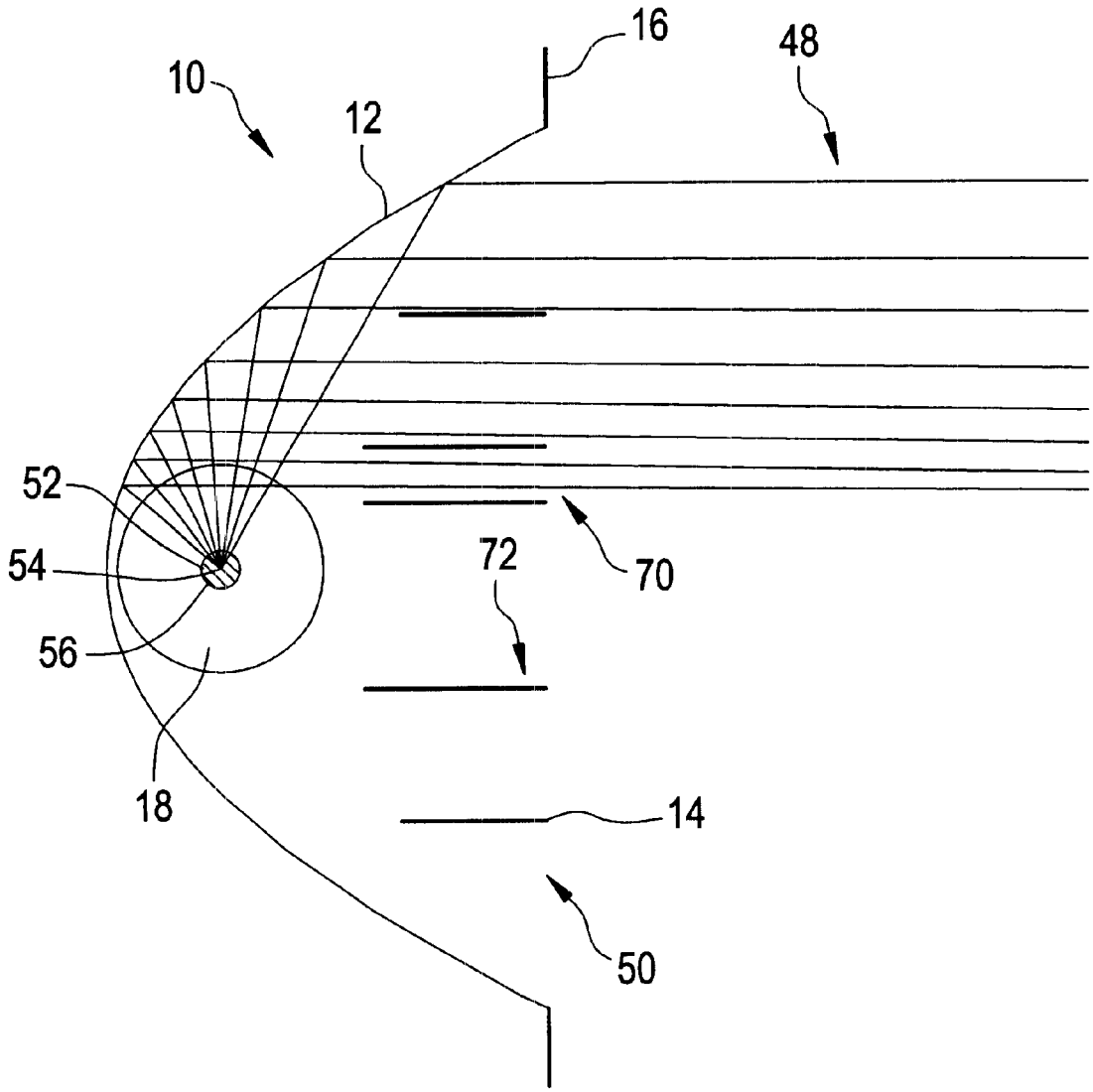
FIG. 7 is a ray trace diagram showing light emitted from an arc tube in a plane normal to the longitudinal axis of the arc tube with respect to the reflector assembly of FIG. 1.

Further, as shown in FIG. 7, since the focal axis 52 of the parabolic shaped reflector 12 is located coincident with the arc tube 56, the parabolic shaped reflector 12 will act as a collimator, redirecting light from the HID lamp 18 into essentially parallel rays 48 at the exit aperture 50 of the parabolic shaped reflector 12.

The width of the beam pattern of the reflected light from the HID lamp 18 may be controlled by the reflector designer by controlling the shape of the parabolic reflector 12. However, the depth of the parabolic reflector 12 bowl is limited by the size of the luminaire housing 38, which in turn is limited by the physical requirement that the luminaire must be manageable by one person for installation and maintenance on a catwalk 26. Further considerations in reflector design include the need to illuminate the PPA 24 with good uniformity, which precludes 'spotlight' type narrow beams which would cast harsh shadows.

Thus, the parabolic shaped reflector 12 of the embodiment described herein has been chosen to produce a NEMA 4×2 type beam pattern.

Figure 8:
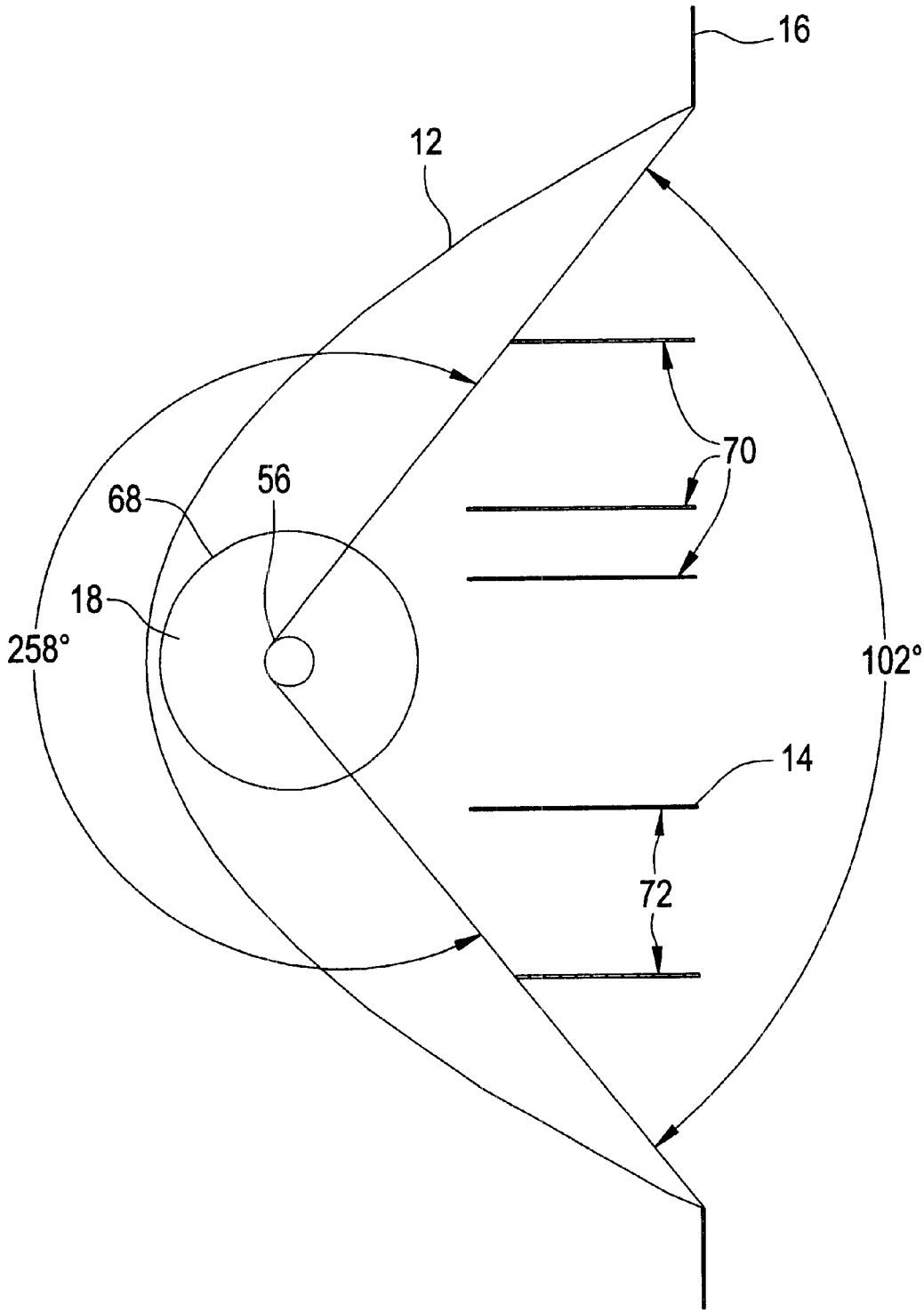
FIG. 8 is a ray trace diagram showing the arc of light from the arc tube not directly used by the reflector of the present invention.

As shown further in FIG. 8, the parabolic shaped reflector 12 of the described embodiment thus envelopes the HID lamp 18 by approximately 258°, leaving a 102° arc of direct light 66 from the lamp, along a vertical section of the reflector assembly 10 approximately in the center of the assembly 10. Illumination in the 258° arc is redirected by the parabolic shaped reflector 12 into a collimated main beam, which provides the focused main illumination area for the NEMA 4×2 beam pattern of the reflector assembly 10.

Figure 9:
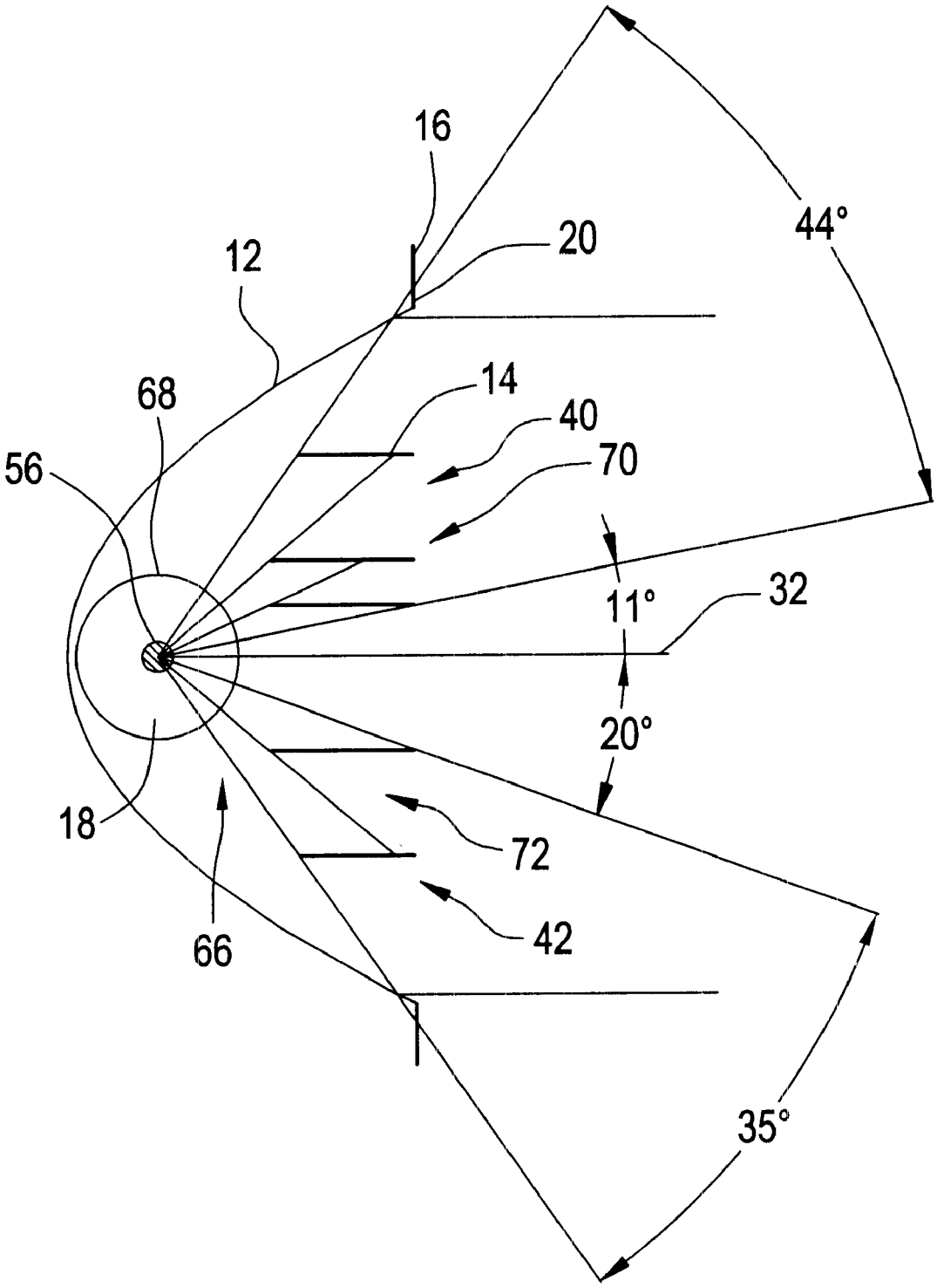
FIG. 9 is a ray trace diagram showing light emitted directly from the arc tube with respect to the louver assembly of FIG. 1.

The ray trace diagrams of FIGS. 7 through 9 are representative of the parabolic shaped reflector 12 along the length of the arc tube 56 of the HID lamp 18. Since the overwhelming majority of the light output from the arc tube 56 of the HID lamp 18 is emitted along the length of the arc tube 56, the diagrams of FIGS. 7 through 9 are representative of the majority of the optical work performed by the reflector assembly 10 of the invention.

Returning to FIGS. 1, and 4 through 6, since a minority of light output from the arc tube 56 of the HID lamp 18 is emitted from the ends of the arc tube 56, the left side 58 and the right side 60 of the parabolic shaped reflector 12 are shaped to redirect the available light into the oblong shaped NEMA 4×2 beam pattern. However, also located along the left side 58 and the right side 60 of the parabolic shaped reflector 12 are a large relamping hole 62 and a lamp socket hole 64. The relamping hole 62 is large enough to allow the HID lamp 18 to be inserted and removed through the hole for installation and maintenance of the luminaire. The socket hole 62 is necessary to attach the lamp base to the socket (not shown) for electrical connection of the lamp to power and for proper positioning of the lamp within the reflector assembly 10. Additionally, a lamp end stabilizer (not shown) may extend through the relamping hole during normal operation of the reflector assembly 10 in order to stabilize the lamp from the vibrations of the catwalk 26. Due to the limited optical work performed by the left side 58 and the right side 60 of the parabolic shaped reflector, the overall efficacy of the reflector assembly 10 is not greatly impacted by the relamping hole 62 or the lamp socket hole 64.

Illumination from the 102° arc of direct light 66 from the lamp if left uncontrolled will 'spill' outside of the NEMA 4×2 pattern area, illuminating the adjacent, spectator seating areas 36 of the arena 22 as shown in FIG. 2. This illumination will produce glare to the spectators seated in those areas, especially from the luminaires located on the catwalk on the opposite side of the PPA due to the greater number and higher aiming angle of those luminaires.

Thus, as shown in FIG. 9, the reflector assembly 10 of the present embodiment utilizes a louver assembly 14 to control direct spill light 66 from the arc tube 56 of the HID lamp 18. The louver assembly 14 is designed such that it does not interfere with the arc of light from the arc tube 56 which is emitted into the main beam 48 of light. The louver assembly 14 must also operate around the outer bulb 68 of the HID lamp 18 and the asymmetric parabolic curves of the parabolic shaped reflector 12. Additionally, the louver assembly 14 must not protrude beyond the pan front surface 20, to allow for operation of the shutter system 46 described above and shown in FIG. 3.

Thus, as shown in FIG. 9 the louver assembly 14 of the present embodiment has an upper group 70 of thin horizontal non-reflective louvers and a lower group 72 of thin horizontal non-reflective louvers which are, thus, parallel to the longitudinal axis of the arc tube 56, parallel to the main beam light rays 48 reflected light from the parabolic shaped reflector 12 (FIG. 7), and parallel to the long edge of the PPA 24 (FIG. 2). This design provides control of the arc of direct light emitted by the arc tube of the HID lamp 18 along the long edge of the PPA 24, while allowing the reflected light of the main beam 48 to be emitted from the reflector assembly 10 essentially unobstructed.

The upper group 70 of louvers and the lower group 72 of louvers are also asymmetric, since the higher angle of the aiming vectors for luminaires aimed at the opposite side of the PPA 24 creates a need for more intense direct light cutoff of light from the top 40 of the parabolic reflector 12 than light emitted from the bottom 42 of the reflector 12. Thus, as shown in FIG. 9, the upper group 70 of louvers of the shown embodiment block direct spill light 66 from the arc tube 56 in a region from about 11° above the aiming vector 32 to about 55° above the aiming vector 32. The lower group 72 of louvers of the shown embodiment block direct spill light 66 from the arc tube 56 in a region from about 20° below the aiming vector 32 to about 55° below the aiming vector 32.

It should be noted that alternative louver designs which vary the quantity, size, and placement of the louvers could be utilized which produce similar spill light control without affecting the overall efficacy of the reflector assembly 10 and without departing from the scope of the claimed invention. It is believed that the configuration described herein, however, is optimized to block unwanted direct light from spilling beyond the bounds of the long side of the PPA 24, whether the luminaire 28, 30 of FIG. 2 is aimed at the far side or the near side of the PPA 24, while requiring the least number of louvers for manufacturing efficiency.

Additionally, as shown in FIG. 1, the louver 74 assembly has vertical louvers located along the left side 58 and the right side 60 of the parabolic shaped reflector 12 for both spill light control along the short side of the NEMA 4×2 beam pattern and as a structural support for the upper group 70 and lower group 72 of horizontal louvers. In the shown embodiment, the vertical louvers 74 are formed integral with the front pan by bending a portion of the front pan 16 material, which would have otherwise been removed for creation of the oblong shaped opening, downward into the parabolic shaped reflector 12.

Further contributing to the efficacy of the embodiment of the reflector assembly 10 described herein, the material selected for the parabolic shaped reflector 12 is an aluminum material having a highly specular finish. More specifically, the preferred embodiment utilizes a reflector having a minimum 94% reflectivity with less than 15% diffuse component. One such product is sold under the trade name ANOMIRO™; however, other materials are also available. Selection of such a high efficiency material ensures that the most possible light is directed where required, and not dispersed as spill light. However, this material is available only in lighting sheets and its efficiency cannot be maintained if it is hydroformed, spun or stamped into the desired reflector geometry. The nature of these processes currently limits the reflectors formed thereby to about 86% maximum reflectivity.

Therefore, the parabolic shaped reflector 12 of the described embodiment is formed by a segmenting process which involves cutting a number of pie shaped reflector sections and bending the sections at appropriate locations to approximate very closely the geometrical shape desired. Thus, the parabolic shaped reflector 12 of the described embodiment is formed from 12 sections joined to form the desired asymmetrical, oblong front reflector opening, with each section being bent in approximately 12 locations to approximate the parabolic shape desired for that section. Thus, the asymmetric parabolic shaped reflector 12 may achieve very high efficacy.

The foregoing detailed description, including specific angular measurements, reflector forming techniques, materials and finishes, is primarily given for clearness of understanding. No unnecessary limitations are to be understood therefrom, for modifications will become obvious to those skilled in the art upon reading this disclosure and may be made without departing from the sprit of the invention or the scope of any appending claims.

What is claimed is:

1. An improved arena light reflecting assembly comprising:

an asymmetric parabolic shaped reflector having an exit aperture, said reflector comprised of a plurality of pie shaped reflector sections, said reflector surrounding a horizontally extending high intensity light source, said reflector having a focal axis that lies along an axis of an arc tube of said light source, whereby said reflector acts as a collimator redirecting light from said light source into essentially parallel rays at said exit aperture;

a pan circumscribing said exit aperture; and, a louver assembly disposed within said exit aperture behind a front surface of said pan.

2. The light reflecting assembly of claim 1 wherein said louver assembly includes an upper group of louvers and a lower group of louvers, said upper and lower group of louvers being asymmetric.

3. The assembly of claim 2, the upper group of louvers positioned to block direct spill light from said arc tube in a region from about 11 degrees above an aiming vector to about 55 degrees above said aiming vector, the lower group of louvers positioned to block direct spill light from said arc tube in a region from about 20 degrees below said aiming vector to about 55 degrees below said aiming vector.

4. The assembly of claim 2, said louver assembly including vertical louvers located along opposed sides of said parabolic shaped reflector.

5. The assembly of claim 4, said vertical louvers being positioned to structurally support said upper group of louvers and said lower group of louvers, said upper group of louvers and said lower group of louvers being horizontally positioned louvers.

6. The assembly of claim 4, said vertical louvers being integral with said front pan.

7. The assembly of claim 1, said parabolic shaped reflector being an aluminum material with a highly specular finish.

8. The assembly of claim 1, said parabolic shaped reflector section being of unitary construction, said pie shaped reflector sections being bent sections at appropriate locations to approximate a preselected geometrical shape.

9. The assembly of claim 1, said parabolic shaped reflector being formed from 12 sections joined to form a desired asymmetrical, oblong front reflector opening.

10. The assembly of claim 1, said parabolic shaped reflector having a left side and a right side shaped to redirect available light into an oblong shaped beam pattern.

11. The assembly of claim 10, said parabolic shaped reflector left side and said parabolic shaped reflector right side having a relamping hole and a lamp socket hole.

12. The assembly of claim 1, said parabolic shaped reflector enveloping said light source by approximately 258 degrees whereby an arc of approximately 102 degrees of direct light from said light source is disposed along a vertical section of said reflector approximately in the center of the reflector, said 258 degree arc being redirected by said parabolic shaped reflector into a collimator main beam.

13. The assembly of claim 1, said front pan having an oblong shaped opening.

14. The assembly of claim 1, said parabolic shaped reflector being an aluminum material with a highly specular finish.

15. A luminaire for arena lighting comprising:

a housing;

a light reflecting assembly received within said housing, said light reflecting assembly comprising an asymmetric parabolic shaped reflector having an exit aperture, said reflector surrounding a horizontally extending high intensity light source, said reflector having a focal axis that lies along an axis of an arc tube of said light source;

a pan circumscribing said exit aperture;

a louver assembly disposed within said exit aperture behind a front surface of said pan; and, a shutter system positionably attached to said housing to open and close said exit aperture.

16. The luminaire of claim 15, said shutter system including a pair of movable shutters positioned on opposite sides of said housing.

17. The luminaire of claim 15 wherein said louver assembly includes an upper group of louvers and a lower group of louvers, said upper and lower group of louvers being asymmetric.

18. The luminaire of claim 17, the upper group of louvers positioned to block direct spill light from said arc tube in a region from about 11 degrees above an aiming vector to about 55 degrees above said aiming vector, the lower group of louvers positioned to block direct spill light from said arc tube in a region from about 20 degrees below said aiming vector to about 55 degrees below said aiming vector.

19. The assembly of claim 17, said louver assembly including vertical louvers located along opposed sides of said parabolic shaped reflector.

20. The luminaire of claim 19, said vertical louvers being positioned to structurally support said upper group of louvers and said lower group of louvers, said upper group of louvers and said lower group of louvers being horizontally positioned louvers.

21. The luminaire of claim 19, said vertical louvers being integral with said front pan.

22. The luminaire of claim 15, said parabolic shaped reflector being an aluminum material with a highly specular finish.

23. The luminaire of claim 15, said parabolic shaped reflector being comprised of a plurality of pie shaped reflector sections.

24. The luminaire of claim 23, said parabolic shaped reflector sections being of unitary construction, said pie shaped reflector sections being bent sections at appropriate locations to approximate a preselected geometrical shape.

25. The luminaire of claim 23, said parabolic shaped reflector being formed from 12 sections joined to form a desired asymmetrical, oblong front reflector opening.

26. The luminaire of claim 15, said parabolic shaped reflector having a left side and a right side shaped to redirect available light into an oblong shaped beam pattern.

27. The assembly of claim 26, said parabolic shaped reflector left side and said parabolic shaped reflector right side having a relamping hole and a lamp socket hole.

28. The assembly of claim 15, said parabolic shaped reflector enveloping said light source by approximately 258 degrees whereby an arc of approximately 102 degrees of direct light from said light source is disposed along a vertical section of said reflector approximately in the center of the reflector, said 258 degree arc being redirected by said parabolic shaped reflector into a collimator main beam.

29. The luminaire of claim 15, said front pan having an oblong shaped opening.

30. An improved arena light reflecting assembly comprising:

an asymmetric parabolic shaped reflector having an exit aperture, said reflector surrounding a horizontally extending high intensity light source, said reflector having a focal axis that lies along an axis of an arc tube of said light source, whereby said reflector acts as a collimator redirecting light from said light source into essentially parallel rays at said exit aperture, said parabolic shaped reflector being comprised of a plurality of pie shaped reflector sections, said parabolic shaped reflector sections being of unitary construction, said pie shaped reflector sections being bent sections at appropriate locations to approximate a preselected geometrical shape;

a pan circumscribing said exit aperture; and, a louver assembly disposed within said exit aperture behind a front surface of said pan, said louver assembly includes an upper group of louvers and a lower group of louvers, said upper and lower group of louvers being asymmetric, said louver assembly including vertical louvers located along opposed sides of said parabolic shaped reflector, said vertical louvers being positioned to structurally support said upper group of louvers and said lower group of louvers, said upper group of louvers and said lower group of louvers being horizontally positioned louvers, said vertical louvers being integral with said front pan.

31. The assembly of claim 30, the upper group of louvers positioned to block direct spill light from said arc tube in a region from about 11 degrees above an aiming vector to about 55 degrees above said aiming vector, the lower group of louvers positioned to block direct spill light from said arc tube in a region from about 20 degrees below said aiming vector to about 55 degrees below said aiming vector.

32. The assembly of claim 30, said parabolic shaped reflector being formed from 12 sections joined to form a desired asymmetrical, oblong front reflector opening.

33. The assembly of claim 30, said parabolic shaped reflector having a left side and a right side shaped to redirect available light into an oblong shaped beam pattern.

34. The assembly of claim 33 said parabolic shaped reflector left side and said parabolic shaped reflector right side having a relamping hole and a lamp socket hole.

35. The assembly of claim 30, said parabolic shaped reflector enveloping said light source by approximately 258 degrees whereby an arc of approximately 102 degrees of direct light from said light source is disposed along a vertical section of said reflector approximately in the center of the reflector, said 258 degree arc being redirected by said parabolic shaped reflector into a collimator main beam.

36. The assembly of claim 30, said front pan having an oblong shaped opening.

* * * * *